United States Patent [19]

Brown et al.

[11] Patent Number: 4,604,052

[45] Date of Patent: Aug. 5, 1986

[54] DUAL-WATER MIXTURE FUEL BURNER

[75] Inventors: Thomas D. Brown, Finleyville; Douglas P. Reehl, Pittsburgh; Gary F. Walbert, Library, all of Pa.

[73] Assignee: The United States of America as represented by the United States Department of Energy, Washington, D.C.

[21] Appl. No.: 728,358

[22] Filed: Apr. 29, 1985

[51] Int. Cl.[4] ..... F23D 11/04

[52] U.S. Cl. ..... 431/168; 239/214.25; 239/223; 110/264

[58] Field of Search ..... 431/168, 169; 110/263, 110/264; 239/214.25, 222.11, 223

[56] References Cited

U.S. PATENT DOCUMENTS

| | | | |
|---|---|---|---|
| 3,862,821 | 1/1975 | Vorms et al. | 431/168 |
| 4,457,695 | 7/1984 | Kummel | 431/168 |

FOREIGN PATENT DOCUMENTS

| | | | |
|---|---|---|---|
| 1119893 | 3/1982 | Canada | 431/168 |
| 4746695 | 10/1968 | Japan | 431/168 |

OTHER PUBLICATIONS

European Patent Application, 0,007,894, published 2/6/80.

*Primary Examiner*—Randall L. Green

*Attorney, Agent, or Firm*—Hugh W. Glenn; Paul A. Gottlieb; Judson R. Hightower

[57] ABSTRACT

A coal-water mixture (CWM) burner includes a conically shaped rotating cup into which fuel comprised of coal particles suspended in a slurry is introduced via a first, elongated inner tube coupled to a narrow first end portion of the cup. A second, elongated outer tube is coaxially positioned about the first tube and delivers steam to the narrow first end of the cup. The fuel delivery end of the inner first tube is provided with a helical slot on its lateral surface for directing the CWM onto the inner surface of the rotating cup in the form of a uniform, thin sheet which, under the influence of the cup's centrifugal force, flows toward a second, open, expanded end portion of the rotating cup positioned immediately adjacent to a combustion chamber. The steam delivered to the rotating cup wets its inner surface and inhibits the coal within the CWM from adhering to the rotating cup. A primary air source directs a high velocity air flow coaxially about the expanded discharge end of the rotating cup for applying a shear force to the CWM in atomizing the fuel mixture for improved combustion. A secondary air source directs secondary air into the combustion chamber adjacent to the outlet of the rotating cup at a desired pitch angle relative to the fuel mixture/steam flow to promote recirculation of hot combustion gases within the ignition zone for increased flame stability.

19 Claims, 10 Drawing Figures

FIG. 2
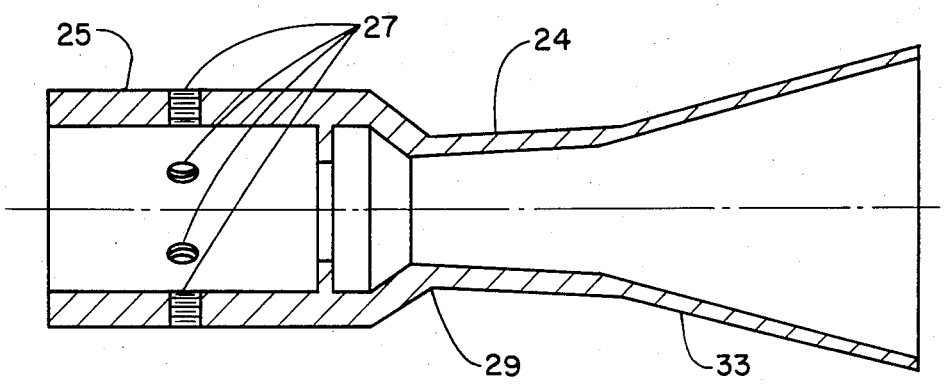
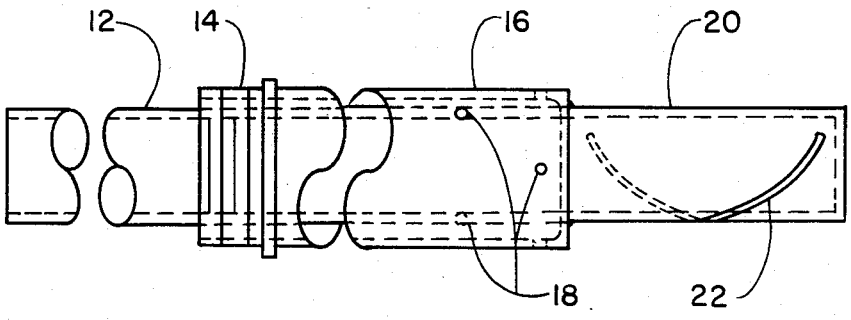
FIG. 3

FIG. 4a
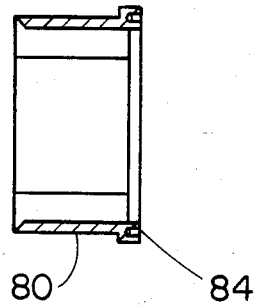
FIG. 4b
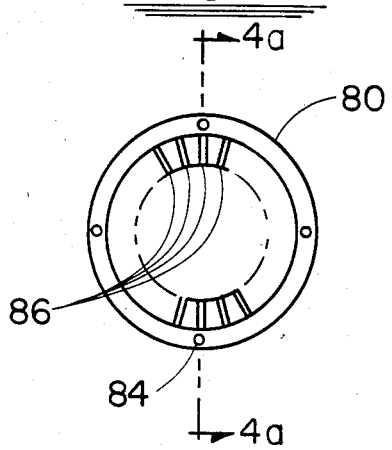
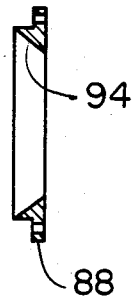
FIG. 5a
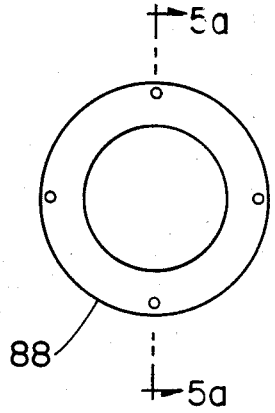
FIG. 5b

DUAL-WATER MIXTURE FUEL BURNER

CONTRACTUAL ORIGIN OF THE INVENTION

The United States Government has rights in this invention pursuant to an employee-employer relationship with the inventors.

BACKGROUND OF THE INVENTION

This invention relates generally to the combustion of hydrocarbon fuels and is particularly directed to an arrangement for directing a coal-water mixture fuel into a boiler for combustion therein.

A bulk liquid fuel is ideally subjected to an atomization process prior to its combustion for ensuring stable and efficient burning. During this atomization process, the liquid fuel is preferably broken up into the smallest possible droplet size to expedite its preheating and to ensure more probable and timely ignition of the fuel. In the case of a coal-water mixture fuel, atomization of the fuel preferably subdivides the bulk fuel to roughly the size of the coal particles suspended within the slurry to allow preheating and ignition to begin immediately for at least some of the coal particles. If the fuel slurry is not subdivided to this extent, the water tends to encase the coal particles and acts as a thermal insulator resulting in ignition delay and burnout of the fuel.

One form which the fuel atomizer/burner has taken is that of a rotating cup having a tapered inner surface extending from a first narrow end to a second expanded end of the cup. When a liquid fuel is provided to the inner surface of the tapered spinning cup at its narrow end, friction causes the fluid to rapidly attain the same tangential speed as the cup. The centrifugal force acting upon the fluid in a direction along the length of the cup causes the liquid to flow toward the lip, or rim, of the cup adjacent to its expanded end portion, which flow is oppposed by viscous drag. By varying the design and operation of the cup, e.g., its degree of taper, its angular velocity, etc., the thickness of the liquid fuel layer may be substantially reduced to promote the break-up of the fuel sheet which forms at and is discharged from the edge of the rotating cup into small droplets for improved fuel atomization and enhanced combustion.

The prior art discloses various fuel nozzle, or burner, arrangements for directing a liquid fuel into a combustion chamber for ignition and burning therein. One such approach is disclosed in patent application Ser. No. 564,127, filed Dec. 21, 1983 in the name of Larry W. Carlson, and assigned to the assignee of the present application. This fuel injection device includes a tubular housing axially mounted at a throat section thereof onto a combustion chamber. An axially adjustable pintle defines an annular chamber between the tubular housing and the combustion chamber. Axial adjustment of the pintle serves to constrict or enlarge the throat opening into the combustion chamber for regulating injection of the fuel into the combustion chamber. In cooperation with the fuel flow through the pintle, there is also provided means for injecting and swirling an oxidant or another fuel within the annular chamber. The discharges are such as to provide generally concentric impinging flows of fuel and oxidant into the combustion chamber. This arrangement provides an efficient means for controlling the tangential and radial directional components of oxidant flow entering the combustion chamber to permit shaping of the combustion plume within the combustion chamber to recirculate hot combustion gases for stable and symmetrical combustion conditions.

In general, prior art fuel burner arrangements for use with coal-water slurry fuels have suffered from various limitations. For example, the build-up of unburned carbon residue adjacent to the exit of the fuel delivery tube reduces the fuel flow within the system and degrades the combustion characteristics of the injected fuel. In addition, prior approaches have met with only limited success in attempting to atomize the fuel slurry to particle sizes on the order of the coal particles suspended within the slurry for preheating the coal and improving its combustion ignition. Failure to fully atomize the fuel slurry leads to the deposit of large collections of fuel particles within the combustion chamber and results not only in inefficient combustion but also leads to combustion chamber fouling as its operating characteristics are degraded by the unburned fuel, or slag, which collects therein.

The present invention thus represents an improvement over the prior art by providing a rotating cup burner arrangement for use with a coal-water mixture fuel which applies a thin, uniform sheet of fuel onto the inner surface of the rotating cup, inhibits the collection of unburned fuel on the inner surface of the cup, reduces the slurry to a collection of fine particles upon discharge from the rotating cup, and further atomizes the fuel as it enters the combustion chamber by subjecting it to the high shear force of a high velocity air flow.

OBJECTS AND SUMMARY OF THE INVENTION

Accordingly, it is an object of the present invention to provide for improved combustion of a coal-water mixture fuel.

It is another object of the present invention to provide an arrangement for introducing a coal-water mixture fuel into a combustion chamber in a manner which provides improved flame control and stability, more efficient combustion of the hydrocarbon fuel, and continuous, reliable burner operation.

Yet another object of the present invention is to provide for the continuous, sustained combustion of a coal-water mixture fuel without the need for a secondary combustion source such as natural gas or a liquid hydrocarbon fuel.

Still another object of the present invention is to provide a burner arrangement capable of accommodating a coal-water mixture fuel having a wide range of rheological and combustion characteristics in providing for its efficient combustion.

This invention contemplates a coal-water mixture fuel burner including a conically shaped rotary cup having a first narrow end portion to which the coal-water mixture fuel slurry is delivered and a second expanded end portion out of which the fuel slurry is directed into a combustion chamber. The fuel slurry is introduced into the rotary cup from a first inner fuel carrying tube. A second outer tube is coaxially positioned about the first inner tube and delivers a stream flow coaxially about the fuel slurry within the rotary cup. The steam flows along the inner surface of the rotating cup and prevents the build-up of unburned, organic residue thereon and, in combination with the centrifugal force imparted by the cup, directs the fuel slurry to the expanded end portion of the cup and into the combustion chamber. A primary air source directs a high velocity air flow coaxially about the expanded end portion of the cup so as to apply a shear force to the exiting fuel slurry for the atomization thereof into fine particles. The primary air flow may be directed either counter to or in the same direction as the rotation of the burner cup or directed linearly about the expanded end portion of the cup for controlling the shear force applied to the fuel mixture. A secondary air source directs heated air into the combustion chamber adjacent to and coaxially about the rotary cup and primary air source to promote recirculation of the hot combustion gases to the ignition zone within the combustion chamber for enhanced flame stability. An adjustable vane arrangement permits the pitch angle and as a result the swirl of the thus introduced secondary air to be varied as desired for improved flame combustion control.

The rotational speed of the burner cup may be varied during operation and its horizontal position with respect to the secondary air inlet and the combustion chamber changed as desired. The high degree of atomization of the coal-water mixture fuel in combination with the recirculating flame pattern within the combustion chamber afforded by the coal-water mixture fuel burner of the present invention provides improved sustained fuel combustion without the requirement for another fuel or heat source such as natural gas or fuel oil.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 2 is a sectional view of a rotary cup atomizer for use in the coal-water mixture fuel burner of FIG. 1;

FIG. 3 is a schematic diagram of the discharge end portions of the fuel delivery and steam delivery tubes of the coal-water mixture fuel burner of the present invention;

FIGS. 4A and 4B respectively show sectional and end-on views of an air diffuser for directing the primary air flow in the coal-water mixture fuel burner of the present invention;

FIGS. 5A and 5B respectively show sectional and end-on views of a back-up ring for controlling the velocity and flow of primary air in the coal-water mixture fuel burner of the present invention;

DETAILED DESCRIPTION OF THE PREFERRED EMBODIMENT

Figure 1:
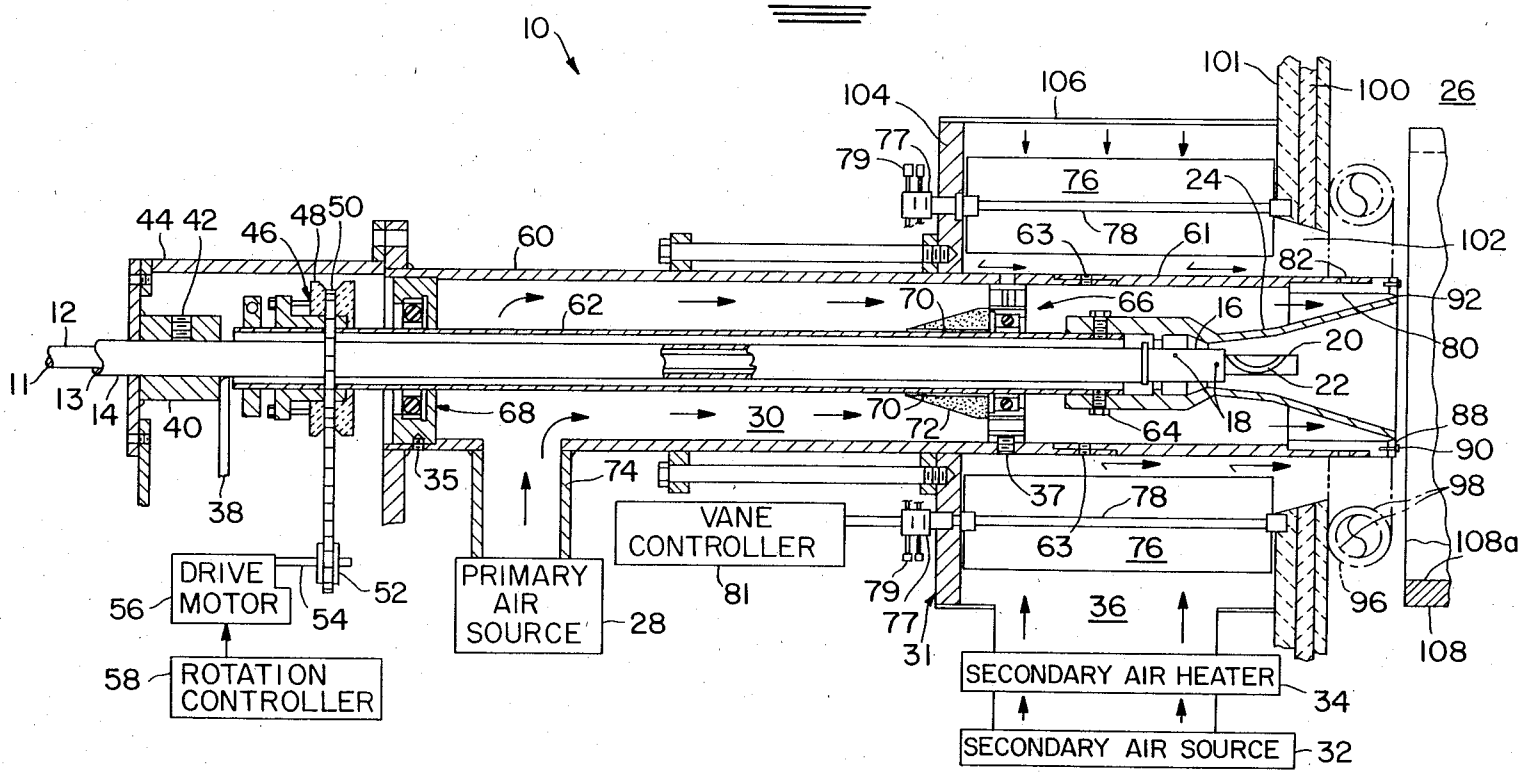
FIG. 1 is a sectional view of a coal-water mixture fuel burner in accordance with the present invention.

Referring to FIG. 1, there is shown a sectional view of a coal-water mixture fuel burner 10 in accordance with the present invention.

The coal-water mixture fuel burner 10 includes an inner fuel delivery tube 12 extending substantially the entire length thereof and including a fuel inlet 11 and a fuel delivery tip 20. Coaxially positioned about and extending substantially along the entire length of the fuel delivery tube 12 is a steam delivery tube 14. The steam delivery tube 14 similarly includes a steam inlet 13 and a steam delivery tip 16 at respective ends thereof. The fuel delivery and steam delivery tubes 12, 14 respectively provide conduits for the delivery of a coal-water mixture fuel slurry and steam to a rotary cup atomizer 24 positioned adjacent to and about the respective delivery tips thereof. Each of these delivery tubes is positioned within the coal-water mixture fuel burner in a fixed manner.

Positioned along the length of the steam delivery tube 14 and spaced from the delivery tip 16 thereof is a tube guide 40 which is maintained in position upon the steam delivery tube by means of two set screws 42. Mounted to the tube guide 40 by conventional means such as welding is a belt guard housing 44. The belt guard housing 44 is, in turn, coupled by conventional means to an intermediate casing 60 for enclosing various portions of the coal-water mixture fuel burner as shown in FIG. 1.

Coaxially positioned about the steam delivery tube 14 and extending substantially the entire length thereof is a support shaft 62. The support shaft 62 is positioned within the intermediate casing 60 and is rotationally coupled thereto by means of forward and aft bearing-/support assemblies 66, 68. The forward and aft bearing/support assemblies 66, 68 permit the support shaft 62 to rotate within the intermediate casing 60. The forward and aft bearing/support assemblies 66, 68 are coupled in a secure manner to the intermediate casing 60 by means of respective sets of three set screws 37 and 35, each positioned 120° apart about the intermediate casing 60. Forward and aft portions of the coal-water mixture fuel burner 10, as used herein, respectively refer to those portions of the burner adjacent to where the fuel slurry and steam enter and to where this mixture exits the burner. As described above, the coal-water mixture fuel as well as the steam is introduced at the left hand portion of the coal-water mixture fuel burner 10 of FIG. 1 and exits at the right hand portion thereof.

The forward portion of the intermediate casing 60 is securely coupled by means of a plurality of set screws 63 to a forward casing 61. Positioned within the forward casing 61 and securely coupled to a forward end portion of the support shaft 62 by means of a plurality of coupling bolts 64 is rotary cup atomizer 24. The delivery tip 20 of the fuel delivery tube 12 is provided with a helical slot 22 through which the coal-water mixture fuel exits for deposit upon the inner, tapered surface of the rotary cup atomizer 24. Similarly, the delivery tip 16 of the steam delivery tube 14 is provided with a plurality of apertures 18 by means of which the steam escapes from the steam delivery tube and is directed onto the tapered inner surface of the rotary cup atomizer 24 prior to its discharge into a combustion chamber 26 positioned adjacent thereto. The combination of the fuel delivery tip 20 and the steam delivery tip 16 is shown in greater detail in FIG. 3. An air tube 38 is positioned adjacent to the aft, open end of the support shaft 62 for limiting the back pressure therein.

A primary air source 28, which may be a conventional blower, is coupled to the intermediate casing 60 by means of an inlet tube 74. Air introduced into the intermediate casing 60 via the inlet tube 74 flows coaxially about the support shaft 62 and along the length thereof toward the rotary cup atomizer 24. The direction of air flow is shown by the arrows in the figure. The forward bearing/support assembly 66 is provided with a plurality of apertures through which the primary air flows into the annular space between the forward casing 61 and the rotary cup atomizer 24. The primary air flows forward along the coal-water mixture fuel burner 10 transiting an annular space 92 defined by the outer surface of the expanded end portion of the rotary cup atomizer 24 and the combination of a diffuser 80 and a back-up ring 88. A transition cone 72, preferably comprised of aluminum, is positioned adjacent and coupled to the forward bearing/support assembly 66 for reducing the pressure drop within the primary air chamber 30 by reducing the drag on the air flow at this position. The transition cone 72 is provided with a Teflon bearing 70 to facilitate rotation of the support shaft 62 therein. The diffuser 80 is coupled to a forward end portion of the forward casing 61 by means of a plurality of set screws 82, while the back-up ring 88 is similarly coupled to a forward edge portion of the diffuser 80 by means of a plurality of set screws 90. The respective forward edge portions of the back-up ring 88 and the rotary cup atomizer 24 define an annular flow channel 92 through which the primary air flow from the coal-water mixture fuel burner 10 into the combustion chamber 26.

Figure 6B:
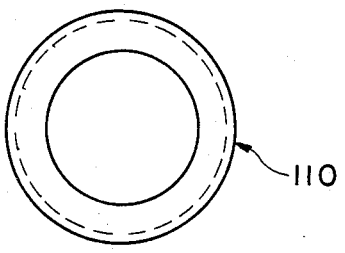
FIGS. 6A and 6B respectively show sectional and end-on views of a burner tip insert for replacing the combination of the air diffuser and back-up ring in the coal-water mixture fuel burner of the present invention when it is not desired to impart a swirl to the primary air.
Figure 6A:
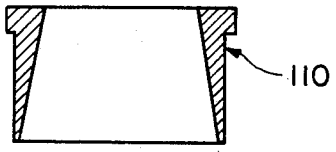

When it is not desired to impart a swirl to the primary air as it enters the combustion chamber 26, a burner tip insert 110 may be positioned adjacent to and about the right hand portion of the coal-water mixture fuel burner 10. FIGS. 6A and 6B respectively show sectional and end-on views of the burner tip insert 110 which is positioned coaxially about the right hand expanded portion of the coal-water mixture fuel burner 10 and which replaces the aforementioned combination of the diffuser 80 and the back-up ring 88 when it is desired to direct the primary air into the combustion chamber 26 along the axis of the coal-water mixture fuel burner without an axial swirl imparted to the primary air.

Located adjacent to a forward end portion of the coal-water mixture fuel burner 10 and positioned coaxially thereabout is a secondary air register 31. The secondary air register 31 includes an aft wall 104 and a generally circular peripheral wall 106 and forms a secondary air flow chamber 36. A first front plate 100 forms one wall of the combustion chamber 26 while a second front plate 101 forms the forward wall of the secondary air flow chamber 36 which is coupled to the combustion chamber 26 via an annular channel 102 coaxially positioned about the forward casing 61.

Coupled to the secondary air flow chamber 36 via a secondary air heater 34 is a secondary air source 32. The secondary air source 32 provides a continuous flow of air which is heated by the secondary air heater 34 to the secondary air flow chamber 36 for introduction into the combustion chamber 26 for supporting the combustion of the coal-water mixture fuel therein. The secondary air source 32 may be a blower or any conventional means for generating an air flow. Similarly, the secondary air heater 34 may take the form of virtually any conventional arrangement for heating and transmitting a continuous flow of air.

Located within the secondary air flow chamber 36 and coaxially positioned about the coal-water mixture fuel burner 10 are a plurality of equally spaced vanes, or fins, 76. Each of the vanes 76 is coupled to an elongated support shaft 78 which is rotationally connected at respective ends thereof to the second front plate 101 and the aft wall 104 of the secondary air register 31. In addition, the end of each support shaft 78 which is inserted within the aft wall 104 of the secondary air register 31 is coupled to a respective sprocket 77. Each of the sprockets 77 is, in turn, coupled to a drive chain 79 for effecting the uniform rotational displacement of each of the vanes as desired. One of the sprockets 77 is coupled to a vane controller 81 by means of which the angular position of all of the vanes 76 within the secondary air register 31 may be controlled for regulating the amount of spin imparted to and the flow of secondary air from the secondary air source 32 into the combustion chamber 26. The vane controller 81 may be conventional in design and operation and could include an electric motor for effecting the rotational displacement of all of the vanes 76 within the secondary air register 31 in unison. In a preferred embodiment, twelve vanes are coaxially positioned about the coal-water mixture fuel burner 10 in an equally spaced manner. By adjusting the angular position of the vanes 76 within the secondary air register 31, the amount of spin imparted to and the flow of secondary air into the combustion chamber 26 may be regulated for controlling the flame recirculation pattern therein. The swirling secondary air flow directed into the combustion chamber 26 by the vanes 76 creates a low pressure area at the outlet of the rotary cup 24 for generating a re-circulating flame pattern with the combustion chamber.

The coal-water mixture fuel burner 10 operates to provide improved combustion of a coal-water mixture fuel in the following manner. A coal-water mixture fuel is introduced into the fuel delivery tube 12 via the fuel inlet 11 and flows along the length of the fuel delivery tube and is exhausted therefrom by means of the helical slot 22 in the fuel delivery tip 20 portion thereof. In addition, steam is introduced into the steam delivery tube 14 via the steam inlet 13 and flows therealong to the steam delivery tip portion 16 thereof. The steam exits the delivery tube 14 via the apertures 18 in the delivery tip portion 16 thereof. The combination of the support shaft 62 and the rotary cup atomizer 24 mounted to one end thereof is rotated at a selected angular velocity by means of the combination of the rotation controller 58 and drive motor 56. The steam is thus delivered to the rotary cup atomizer 24 immediately upstream of the coal-water mixture fuel delivery position permitting the steam to wet the inner, conical surface of the rotary cup atomizer for inhibiting the coal in the coal-water slurry from adhering to the rotary cup. The rotary cup 24 is shown in greater detail in FIG. 2 and includes an aft mounting portion 25 having a plurality of threaded apertures 27 therein, an intermediate portion 29, and a forward cone-shaped portion 33.

The angular velocity of the rotary cup atomizer 24 may be fixed as desired so as to accommodate coal-water slurries having a wide range of rheological characteristics. The helical slot 22 in the fuel delivery tip 20 of the fuel delivery tube 12 delivers the coal-water mixture fuel to the inner, tapered surface of the rotary cup atomizer 24 where it is deposited thereon in the form of a thin sheet. The steam delivered to the rotary cup atomizer 24 wets its inner, tapered surface for inhibiting the coal in the coal-water slurry from adhering to the rotary cup and ensuring that the entire coal-water mixture fuel is directed into the combustion chamber 26 by the rotary cup atomizer 24. The centrifugal force exerted upon the coal-water mixture fuel by the rotating rotary cup atomizer 24 in combination with the steam flow applied to the inner, tapered surface of the rotary cup urges the fuel mixture toward the expanded, open end portion of the rotary cup. The coal-water mixture fuel separates from the rotary cup atomizer 24 in the form of a thin liquid layer, or sheet, which is directed into the combustion chamber 26.

The primary air flow generated by the primary air source 28 and provided via the primary air flow chamber 30 to the annular flow channel 92 adjacent to the periphery of the enlarged end portion of the rotary cup atomizer 24 is directed into the combustion chamber 26. As previously described, the primary air is directed through the combination of a diffuser 80 and a back-up ring 88 or through the burner tip insert 110. Various details of the diffuser 80 are shown in the cross sectional and end-on views of FIGS. 4A and 4B. Similarly, details of the back-up ring 88 are illustrated in the cross sectional and end-on views of FIGS. 5A and 5B.

The inner circumference of the diffuser 80 is provided with a plurality of vanes 86 in an equally spaced manner. Each of the vanes 86 is positioned at a selected angular orientation relative to the flow of primary air through the diffuser 80 so as to deflect primary air in a given direction. Thus, the primary air may be deflected by the diffuser 80 in the same direction as or counter to the rotational displacement of the coal-water mixture fuel as it leaves the rotating cup atomizer 24. By directing the primary air flow counter to the rotational displacement of the coal-water mixture fuel, maximum shear and as a result increased fuel atomization may be achieved. Thus, the direction and extent of primary air deflection relative to the flow of the coal-water mixture fuel as it enters the combustion chamber may be selected in accordance with the rheological characteristics of the fuel mixture in order to provide optimum fuel atomization for improved combustion efficiency.

As shown in FIG. 5A, the back-up ring 88 includes an angled flow detection surface 94 positioned about the inner circumference thereof. The flow deflection surface 94 re-directs the primary air flow about the rotary cup atomizer 24 toward its longitudinal axis in applying a shear force to the coal-water mixture fuel directed into the combustion chamber 26 by the rotary cup. By changing the rotational speed of the rotary cup atomizer 24 as well as the angle at which the primary air impacts the coal-water mixture fuel as it exits the rotary cup atomizer, the extent of atomization of the fuel mixture may be controlled so as to accommodate a range of rheological characteristics of the fuel slurry. Increasing the deflection angle of the flow deflection surface 94 relative to the direction of flow of the fuel mixture will, of course, increase the shear force applied to the fuel mixture resulting in increased atomization thereof. In addition, reducing the size of the annular flow channel 92 between the back-up ring 88 and the rotary cup atomizer 24 will increase the velocity of the primary air as it impacts the coal-water mixture fuel and will increase the atomization thereof.

A natural gas ring 96 having a plurality of apertures 98 therein may be positioned immediately adjacent to the front plate 100 and around the periphery of the annular channel 102 through which the secondary air flows into the combustion chamber 26. In a preferred embodiment, the natural gas ring 96 is generally circular and includes eight equally spaced apertures about the length thereof. The natural gas ring 96 may provide natural gas for initiating operation of the coal-water mixture fuel burner 10 of the present invention. Once stable combustion of the coal-water mixture fuel flowing through the mixture burner of the present invention is established, the supply of natural gas to the combustion chamber may be terminated with the coal-water mixture burner providing the fuel slurry to the combustion chamber for sustaining combustion therein.

Figure 7:
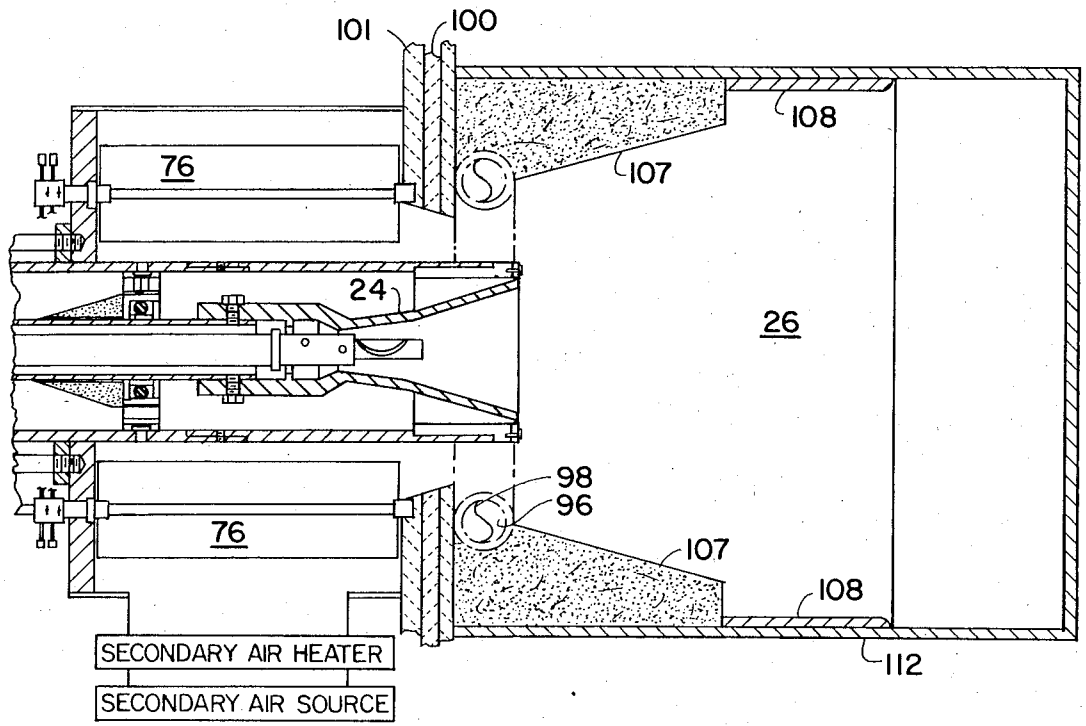
FIG. 7 is a cross-sectional view of the coal-water mixture fuel burner of the present invention attached to a conventional boiler for directing the coal-water mixture fuel into the boiler's combustion chamber.

Referring to the cross-sectional view of FIG. 7, a refractory flame oven cone 107 and a refractory ring 108 are positioned within the combustion chamber 26 of a conventional four-pass industrial fire tube boiler 112 adjacent to the coal-water mixture fuel burner 10. The refractory flame oven cone 107 and the refractory ring 108 serve to reflect heat back into the ignition zone for enhanced flame stability. In addition, the swirling air vented into the combustion chamber from the secondary air register 31 by means of the vanes 76 therein creates a low pressure area immediately adjacent to the outlet of the rotating cup atomizer 24. This low pressure area assists in the formation of a recirculating flame pattern between the refractory 108 and the rotary cup atomizer 24 for sustaining combustion of the coal-water mixture fuel.

When it is not desired to impart a swirl to the primary air as it enters the combustion chamber 26, a burner tip insert 110 may be positioned adjacent to and about the right hand portion of the coal-water mixture fuel burner 10. FIGS. 6A and 6B respectively show sectional and end-on views of the burner tip insert 110 which is positioned coaxially about the right hand expanded portion of the coal-water mixture fuel burner 10 and which replaces the aforementioned combination of the diffuser 80 and the back-up ring 88 when it is desired to direct the primary air into the combustion chamber 26 along the axis of the coal-water mixture fuel burner without an axial swirl imparted to the primary air.

There has thus been shown a coal-water mixture fuel burner for providing efficient combustion of the coal slurry fuel without the requirement of continuous back-up ignition from a natural gas or oil burner which is easily retrofitted to existing conventional rotary cup oil burners, is easily adapted to accommodate a wide range of coal-water mixture fuel slurry rheological characteristics, and inhibits the build-up of unburned carbon residue which degrades burner operation.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. A coal-water mixture fuel burner coupled to a combustion chamber comprising:

a rotating cup having a first open narrow end, a second open expanded end and a tapered inner portion positioned therebetween, wherein the second expanded end of said rotating cup is positioned adjacent to and in communication with an aperture in the combustion chamber;

first inner conduit means connected to a coal-water mixture fuel source and having a first end positioned within the first open narrow end of said rotating cup for directing said coal-water mixture fuel within said rotating cup; and second outer conduit means connected to a source of steam and coaxially positioned about said first inner conduit means along a portion of the length thereof and including a first end positioned within the first open narrow end of said rotating cup and along the length of said first inner conduit means for directing said steam flow onto the tapered inner portion of said rotating cup for facilitating the flow of the coal-water mixture fuel along said rotating cup and its discharge in a collection of fine particles therefrom into the combustion chamber.

2. The coal-water mixture fuel burner of claim 1 wherein the first end of the first inner conduit means includes a helical slot positioned in a lateral surface of the first inner conduit means through which the coal-water mixture fuel flows into said rotating cup.

3. The coal-water mixture fuel burner of claim 1 wherein the first end of said second outer conduit means includes a plurality of apertures therein through which the steam flow directed onto the tapered inner portion of said rotating cup passes.

4. The coal-water mixture fuel burner of claim 1 further comprising rotational drive means coupled to said cup for effecting the rotation thereof.

5. The coal-water mixture fuel burner of claim 4 wherein said rotational drive means is variable for setting the angular velocity of said rotating cup in accordance with the rheological properties of the coal-water mixture fuel.

6. The coal-water mixture fuel burner of claim 5 further comprising an elongated hollow shaft coaxially positioned about said second outer conduit means and coupled at respective ends thereof to said rotational drive means and to said rotating cup in providing support therefor.

7. The coal-water mixture fuel burner of claim 6 wherein said rotational drive means includes the combination of an electric motor and a drive belt coupled to said hollow shaft for effecting the rotation thereof.

8. The coal-water mixture fuel burner of claim 6 wherein said elongated hollow shaft is coupled to the first narrow end of said rotating cup.

9. The coal-water mixture fuel burner of claim 1 further comprising a primary air source for directing high velocity air across the second expanded end of said rotating cup for exerting a shear force upon the coal-water mixture fuel discharged therefrom as it enters the combustion chamber for further atomization of said coal-water mixture fuel.

10. The coal-water mixture fuel burner of claim 9 wherein said primary air source includes a blower and a duct coupling said blower to said rotating cup immediately adjacent to the second expanded end thereof.

11. The coal-water mixture fuel burner of claim 10 wherein said duct is coaxially positioned about said second outer conduit means and said rotating cup.

12. The coal-water mixture fuel burner of claim 11 further comprising deflection means positioned within said duct adjacent to the second expanded end of said rotating cup for directing the primary air generally inward toward a longitudinal axis of said rotating cup.

13. The coal-water mixture fuel burner of claim 12 wherein said deflection means comprises an annular member coaxially positioned in spaced relation about said rotating cup and including a plurality of vanes positioned about an inner periphery thereof for deflecting the primary air in a swirling motion about the second expanded end of said rotating cup.

14. The coal-water mixture fuel burner of claim 13 wherein the velocity of the primary air adjacent to the second expanded end of said rotating cup may be varied by varying the size of an annular flow channel between said annular member and said rotating cup.

15. The coal-water mixture fuel burner of claim 1 further comprising a secondary air source for directing secondary air into the combustion chamber about the periphery of the second expanded end of said rotating cup for controlling the combustion of the coal-water mixture fuel.

16. The coal-water mixture fuel burner of claim 15 wherein said secondary air source includes a blower coupled to an annular chamber about said rotating cup, wherein a plurality of adjustable vanes are positioned within said annular chamber for directing the secondary air into the combustion chamber at a desired entry angle.

17. The coal-water mixture fuel burner of claim 1 further comprising a secondary fuel source positioned within the combustion chamber adjacent to said rotating cup for initiating combustion of the coal-water mixture fuel.

18. The coal-water mixture fuel burner of claim 17 wherein said secondary fuel source includes a circular ring positioned within the combustion chamber and immediately adjacent to and about the second open expanded end of said rotating cup, said circular ring having at least one aperture therein through which a combustible fuel is directed into the combustion chamber.

19. The coal-water mixture fuel burner of claim 17 wherein said combustion chamber is a fire tube boiler having a refractory flame oven cone and a refractory ring therein, wherein said refractory flame oven cone and said refractory ring are positioned adjacent to said circular ring secondary fuel source and the second open expanded end of said rotating cup for reflecting heat back into an ignition zone within the combustion chamber for enhanced flame stability.

* * * * *

UNITED STATES PATENT AND TRADEMARK OFFICE

CERTIFICATE OF CORRECTION

PATENT NO. : 4,604,052

DATED : August 5, 1986

INVENTOR(S) : Thomas D. Brown, Douglas P. Reehl, and Gary F. Walbert

It is certified that error appears in the above-identified patent and that said Letters Patent is hereby corrected as shown below:

On the title page, Item /54/

Correct the Title to read as follows:

COAL-WATER MIXTURE FUEL BURNER

Signed and Sealed this

Thirtieth Day of December, 1986

*Attest:*

DONALD J. QUIGG

*Attesting Officer*

*Commissioner of Patents and Trademarks*